United States Patent [19]

Hartwig

[11] Patent Number: 4,722,317

[45] Date of Patent: Feb. 2, 1988

[54] ARCHERY BOW

[76] Inventor: Jim L. Hartwig, Rte. 1, Box 102, Dewey, Okla. 74029

[21] Appl. No.: 920,998

[22] Filed: Oct. 20, 1986

[51] Int. Cl.[4] ..... F41B 5/00

[52] U.S. Cl. ..... 124/23 R; 124/DIG. 1

[58] Field of Search ..... 124/23 R, 24 R, 25, 124/DIG. 1

[56] References Cited

U.S. PATENT DOCUMENTS 3,108,583 10/1963 Andis ..... 124/25
3,515,113 6/1970 Lawrence ..... 124/25
3,851,638 12/1974 Alexander ..... 124/24 R
4,178,904 12/1979 Meininger ..... 124/23 R
4,553,522 11/1985 Topping ..... 124/89

*Primary Examiner*—Richard C. Pinkham
*Assistant Examiner*—Benjamin Layno
*Attorney, Agent, or Firm*—Edward L. Bowman

[57] ABSTRACT

A compact easily maneuverable archery bow comprising a handle, flexible limbs extending forward of a said handle, a bowstring, and structure coupling the bowstring and the resilient limbs so that as the bowstring is drawn back rearwardly of the handle the limbs are pulled inwardly back toward the front of the handle to provide force needed for propelling an arrow or the like.

12 Claims, 3 Drawing Figures

ARCHERY BOW

FIELD OF THE INVENTION

This invention relates to bows suitable for propelling an arrow, bolt, or the like. This invention is thus applicable to bows having cables and pulleys which cooperate to place tension on the bow limbs as the bowstring means is drawn, i.e. pulled away from the bow frame or handle. This invention is particularly applicable to those bows which have come to generally be known as compound bows, including of course, those bows having cable and pulley systems which require lesser pull weight at full draw than at an intermediate position of draw.

This invention relates further to the subject matter of Disclosure Document No. 154462, which the inventor filed in the U.S. Patent Office on Aug. 11, 1986. The disclosure of that Disclosure Document is incorporated herein by reference.

BACKGROUND OF THE INVENTION

In recent years a number of refinements have been made in bows for archery. The development of compound archery bows is considered to have done much to enhance the popularity of archery for both target and game shooting.

One of the advantages of the compound bow resides in the reduction in the amount of strength required to maintain the bow in a fully drawn position. Another of the advantages of the compound bow has been its ability to project arrows at high velocity while having a much more compact size than the long bows of years past. However, there are some circumstances when even compound bows have drawbacks particularly when they are used for hunting game.

One of the main drawbacks for both compound bows and long bows is that the limbs often make it difficult for one to shoot the bow while sitting or when one is shooting from a position in which the limbs may contact an obstruction such as a tree limb when the bow is drawn or swung to place the arrow on game.

An object of the present invention is to provide a bow which is much more compact than most bows of similar strength.

Still another object of this invention is to provide a bow which can be drawn without fear of interference from obstructions such as the ground, a tree stand, or tree limbs.

Still yet another object of the present invention is to provide a bow which is much more maneuverable in the field than bows heretofore known.

SUMMARY OF THE INVENTION

In accordance with the present invention there is provided an archery bow having (a) a handle having spaced apart ends, (b) a pair of elongated resilient flexible limbs connected to the opposite end portions of said handle and terminating in spaced-apart free tips, (c) a bowstring, (d) structure coupling said bowstring and the limbs. The limbs in the bow of this invention extend forward and inward relative to the handle rather than extending outwardly and rearwardly as seen in conventional bows, particularly conventional compound bows. The bowstring for this invention has a central portion spaced apart from and rearward of the handle as in a conventional bow.

DETAILED DESCRIPTION

Figure 1:
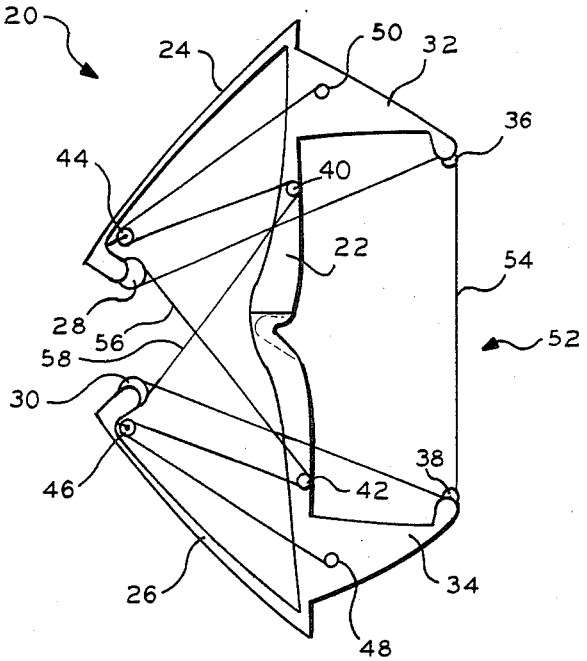
Figure 2:
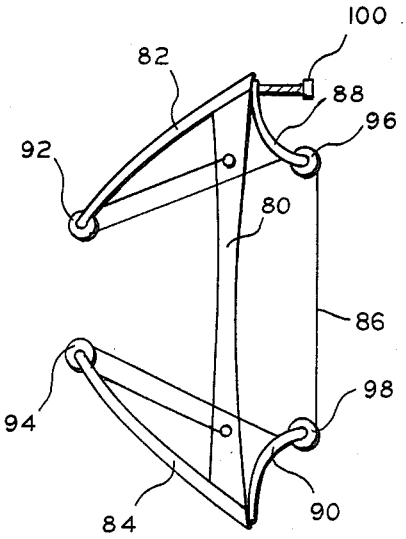
Figure 3:
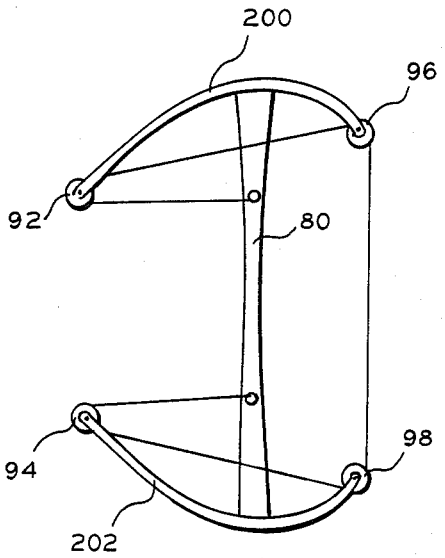

A further understanding of the invention and its objects and advantages will be provided by the following more detailed description taken in conjunction with the drawings wherein, FIG. 1 is a side elevational view one preferred embodiment of the present invention, FIG. 2 is a diagramatical side elevational view of another embodiment of the present invention, and FIG. 3 is a diagramatical side elevational view of still another embodiment of the present invention.

In the embodiment illustrated in FIG. 1 the bow 20 is provided with a handle section 22. A pair of elongated resilient flexible limbs 24 and 26 are attached to the opposite ends of the handle section 22. The limbs 24 and 26 extend forwardly and inwardly relative to the front of the handle 22. The limbs terminate in spaced-apart free tips to which eccentric pulleys 28 and 30 are rotatably mounted.

A pair of stationary arms, 32 and 34 are attached to opposite end portions of the rear of handle section 22. The arms extend rewardly and preferably inwardly, as illustrated, relative to the handle section 22. Pulleys 36 and 38 are rotably mounted on the arms 32 and 34. In a particularly preferred embodiment the arms are of such dimensions and weight as to counterbalance the weight of the limbs 24 and 26 so that when an archer grips the central portion of the handle there will be minimal if any downward force tending to cause the bow to tip forward. Alternatively, it is also within the scope of the invention to have other means associated with the bow for providing a counterbalance effect.

Pulleys 40 and 42 are rotably mounted to upper and lower mid sections of the handle section 22. Further, pulleys 44 and 46 are rotatably mounted to the tips of the limbs 24 and 26 adjacent the eccentric pulleys 28 and 30. Anchor pins 48 and 50 are attached to arms 32 and 34.

A bowstring 52 is strung around members 36 and 38 to present a central stretch 54 and a pair of end stretches 56 and 58. Bowstring end stretch 56 passes from pulley 36 and around eccentric pulley 28. From there stretch 56 is passed around pulleys 42 and 46 and terminates at anchor pin 48 which serves as a bowstring or cable stop which secures the free end of stretch 56. Bowstring end stretch 58 passes from pulley 38 and around eccentric pulley 38 and then around pulley 40 and 44, to finally terminate at anchor pin 50, which secures said end stretch.

The vertical positioning of the various pulleys and the bow structure should preferably be such as to minimize the two end stretches of the bowstring from contacting each other when the bow is being used to propel an arrow. Likewise it is desirable to ensure that the end stretches of the bowstring do not rub against the handle 22 of the bow since such contact would interfer with the smooth operation of the bow and would lead to premature wear of the bowstring. One method of insuring that there is no undue contact between the bowstring and the handle is to provide slots, grooves, or indented areas in the handle which provide for additional clearance between the bowstring and the handle.

To use the bow of FIG. 1, an arrow is nocked on the central portion 54 of the bowstring 52. As the central portion of the bowstring 52 is pulled away from the rear of the handle 22 the limbs 24 and 26 are pulled backward toward the front of handle 22. When the bowstring is released after being so drawn the bowstring 52 and the limbs have a synchronized continuous forward motion which propelles the arrow. Obviously, the limbs 24 and 26 must be of lengths which allow the arrow to pass between their terminal ends as it is propelled away from the bow.

Due to the presence of the eccentric pulleys 28 and 30 in the bow illustrated in FIG. 1, the bow will operate with the same mechanical advantages of conventional compound bows. Thus the eccentric pulleys 28 and 30 operate to cause the bowstring to increase in tension as it is drawn from a rest position to some intermediate draw position and then to decrease as the bowstring is drawn to a still more fully drawn position.

It should be noted that while the embodiment illustrated in FIG. 1 employs a particular arrangemnet of the pulleys and the bowstring other arrangements could be substituted. All that is really necessary is a structure which couples the bowstring with the forward extending reversed flexible limbs so that when the central portion of said bowstring is pulled rearward said limbs are pulled from a rest position back to a flexed position. It should also be noted that the bow of the present invention can include other features generally found in conventional bows. Particularly, it is obviously advantageous to have a arrow rest located near the center of the handle 22, most preferably on the side of the handle opposite that illustrated in FIG. 1.

If one desires to incorporate the advantages of the compound bow into the inventive bow, there are obviously many ways in which a skilled mechanic can adapt the activating structure of known conventional compound bows to act as the activating structure for the inventive bow. Many different systems and arrangements of pulleys, levers, springs, and the like are known in the art as being suitable for providing the mechanical advantages desired for a compound bow. Some typical examples of such systems are disclosed in U.S. Pat. Nos. 3,486,495; 3,841,295; 3,854,467; 3,958,551; 3,967,609; 3,923,035; 3,945,368 4,187,826; and 4,455,990, the disclosures of which are incorporated herein by reference.

The bow of this invention can be formed of any of the materials that are used to make archery bows. The relative dimensions and strengths of the materials can be selected by a mechanic or engineer using routine skill to give the type of performance desired.

One particular advantage of the present invention is that it will permit one to construct a bow that is much more compact and maneuverable than the long bows or compound bows currently available. In accordance with this invention it is possible to have bows having an overall length of no more than 36 inches, more preferably no more than 34 inches, and a width from front to back of more than 25 inches, more preferably no more than 21 inches. Of course, larger bows can be made using the invention if such is desired.

Another variation of the present invention is shown in FIG. 2. The bow illustrated in FIG. 2 has a handle 80, forward extending flexible limbs 82 and 84, and a bowstring 86. The bow of FIG. 2 differs from that of FIG. 1 in that the stationary arms 32 and 34 of the FIG. 1 bow have be replaced with flexible resilient limbs 88 and 90. Pulleys 92 and 94 are attached to the ends of foward limbs 82 and 84. Pulleys 96 and 98 are attached to the end of rear limbs 88 and 90. In this embodiment the ends of the bowstring are secured to anchor pins located on the handle. Also included is a counterbalancing device 100 comprising an adjustable weighted rod extending rewardly from an upper portion of the handle of the bow. In this embodiment the flexible rear limbs 88 and 90 flex inwardly as the bowstring is drawn and thus add additional force to the arrow when it is propelled upon the release of the drawn bowstring. While the pulleys on the front and rear limbs could all be just conventional wheels rotatable about a centered axis, preferably the pulleys of at least the front limbs are eccentric pulleys which provide the benefits provided in compound bows as previously described.

The embodiment illustrated in FIG. 3 operates in much the same fashion as that the FIG. 2. The bow of FIG. 3 differs from that of FIG. 2 in that the flexible forward and rearward limbs of the bow of FIG. 2 have been replaced by a single pair of curved flexible resilient limbs 200 and 202 which are attached to the ends of the handle and which have terminal ends extending both forward and rearward of the handle.

Although particular preferred embodiments of the present invention have just been described in detail for illustration purposes, it will be recognized that numerous variartions or modifications of the disclosed apparatus will lie within the scope of this invention.

What is claimed is:

1. An archers bow comprising (a) a handle having spaced apart ends; (b) a pair of elongated flexible resilient limbs connected to opposite end portions of said handle, extending forward of said handle, and ending in free terminal tips spaced apart in front of said handle; (c) a bowstring having a central portion rearward of said handle; (d) structure coupling said bowstring with said limbs in such a fashion that when the central portion of said bowstring is drawn rearward of said handle said limbs are pulled back toward the front of the handle to store potential energy that will be released when the drawn bowstring is released, said structure comprising arms attached to opposite end portions of the handle and extending rearwardly therof; rotatably mounted pulleys attached to each of arms; rotatably mounted pulleys attached to each of the forwardly extending flexible limbs; wherein said bowstring has opposite end portions extending from said central portion; and wherein said end portions are passed around said pulleys of said limbs and of said arms and are secured to the bow in such a fashion that when the central portion of the bowstring is drawn away from the back of the handle the flexible limbs will be drawn back toward the front of the handle.

2. A bow according to claim 1 wherein said bow includes means which cooperates with said bowstring to increase the bowstring tension as the bowstring is drawn from the rest position to an intermediate drawn position and then to decrease the bowstring tension as the bowstring is drawn from said intermediate position to a more fully drawn position.

3. A bow according to claim 1 wherein said bow includes means for establishing an intermediate position in the draw of the bowstring where the applied force required to hold the bowstring in that position is greater than the force required to hold the bowstring in a more fully drawn position.

4. A bow according to claim 1 wherein said arms are stationary and nonresilient.

5. A bow according to claim 4 wherein said pulleys of said forwardly extending limbs are eccentric pulleys.

6. A bow according to claim 5 wherein said arms are of such weight that said amrs counterbalance the weight of the forward extending flexible limbs.

7. A bow according to claim 6 wherein the end portion of the bowstring that is strung around the pulley of the lower arm is strung around the pulley of the lower limb and the end portion of the bowstring that is strung around the pulley of the upper arm is strung around the pulley of the upper limb.

8. A bow according to claim 7 wherein said bow includes means for establishing an intermediate position in the draw of the bowstring where the applied force required to hold the bowstring in that position is greater than the force required to hold the bowstring in a more fully drawn position.

9. A bow according to claim 1 wherein said arms are flexible resilient limbs.

10. A bow according to claim 1 having a counterbalance means attached to an upper portion of the handle and extending rearwardly thereof.

11. A bow according to claim 1 wherein a pair of curved flexible resilient limbs are attached to the opposite ends of said handle, each limb having two ends one of which extends forward of said handle and the other which extends rearward of the handle, said forward extending portions comprising said forward extending limbs and the rearwardly extending portions comprising said rearwardly extending arms.

12. A bow according to claim 11 wherein said pulleys of said fowardly extending limbs are eccentric pulleys.

* * * * *